US010680376B2

(12) United States Patent
Shimizu

(10) Patent No.: US 10,680,376 B2
(45) Date of Patent: Jun. 9, 2020

(54) CONNECTOR INCLUDING SPACER FOR RESTRICTING MOVEMENT OF TERMINAL METAL FITTINGS IN HOUSING CHAMBERS

(71) Applicant: Yazaki Corporation, Minato-ku, Tokyo (JP)

(72) Inventor: Tomohiko Shimizu, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/052,687

(22) Filed: Aug. 2, 2018

(65) Prior Publication Data

US 2019/0044269 A1 Feb. 7, 2019

(30) Foreign Application Priority Data

Aug. 4, 2017 (JP) ..... 2017-151686

(51) Int. Cl.

| | |
|---|---|
| ***H01R 13/436*** | (2006.01) |
| ***H01R 13/10*** | (2006.01) |
| *H01R 13/629* | (2006.01) |
| *H01R 13/422* | (2006.01) |

(52) U.S. Cl.

CPC ..... *H01R 13/4361* (2013.01); *H01R 13/10* (2013.01); *H01R 13/4223* (2013.01); *H01R 13/62933* (2013.01); *H01R 13/62938* (2013.01)

(58) Field of Classification Search

CPC . H01R 13/4362; H01R 13/4361; H01R 13/10
USPC ..... 439/752
See application file for complete search history.

(56) References Cited

U.S. PATENT DOCUMENTS

| | | | | |
|---|---|---|---|---|
| 6,702,625 | B2 | 3/2004 | Endo | |
| 9,666,970 | B2 | 5/2017 | Kida | |
| 2003/0073353 | A1 | 4/2003 | Endo | |
| 2003/0087563 | A1 | 5/2003 | Endo | |
| 2004/0005822 | A1* | 1/2004 | Fujita | H01R 13/4362 439/752 |
| 2005/0170703 | A1* | 8/2005 | Nakamura | H01R 13/4362 439/752 |

(Continued)

FOREIGN PATENT DOCUMENTS

| | | | |
|---|---|---|---|
| JP | 2003-115341 | A | 4/2003 |
| JP | 2003-123892 | A | 4/2003 |
| JP | 2015-195124 | A | 11/2015 |

*Primary Examiner* — Abdullah A Riyami
*Assistant Examiner* — Marcus E Harcum
(74) *Attorney, Agent, or Firm* — Banner & Witcoff, Ltd.

(57) ABSTRACT

A connector includes a housing, a terminal metal fitting inserted into a housing chamber forwardly in a housing direction, and a spacer locking the terminal metal fitting. The terminal metal fitting has a plate-like lock piece extending in the housing direction. The terminal metal fitting is locked by contacting a rear edge of the lock piece with the spacer. The housing has an opening region between two adjacent terminal housing chambers and a support wall extending from a peripheral end portion of the opening region backwardly in the housing direction. The support wall supports a tip portion of the terminal metal fitting to eliminate movement of the tip portion through the opening region, even when the terminal metal fitting moves backwardly in the housing direction while allowing the rear edge of its lock piece to dig into the spacer.

3 Claims, 4 Drawing Sheets

(56) References Cited

U.S. PATENT DOCUMENTS

| | | | | |
|---|---|---|---|---|
| 2006/0068647 | A1* | 3/2006 | Kojima | H01R 13/4223<br>439/752 |
| 2006/0189219 | A1* | 8/2006 | Yamashita | H01R 13/4362<br>439/752 |
| 2007/0275609 | A1* | 11/2007 | Lamdiziz | H01R 13/4362<br>439/752 |
| 2013/0115801 | A1* | 5/2013 | Kobayashi | H01R 13/4362<br>439/372 |
| 2013/0273764 | A1* | 10/2013 | Kitajima | H01R 13/62<br>439/345 |
| 2015/0038022 | A1* | 2/2015 | Kataoka | H01R 13/426<br>439/752 |
| 2015/0099404 | A1* | 4/2015 | Iida | H01R 13/4361<br>439/752 |
| 2017/0025780 | A1 | 1/2017 | Kida | |

* cited by examiner

CONNECTOR INCLUDING SPACER FOR RESTRICTING MOVEMENT OF TERMINAL METAL FITTINGS IN HOUSING CHAMBERS

CROSS-REFERENCES TO RELATED APPLICATION(S)

This application is based on and claims priority from Japanese Patent Application No. 2017-151686 filed on Aug. 4, 2017, and the entire contents of which are incorporated herein by reference.

BACKGROUND

Field of the Invention

The present invention relates to a connector that is equipped with a housing having plural terminal housing chambers, terminal metal fittings that are housed in the respective terminal housing chambers, and a spacer that locks the terminal metal fittings so as to restrict movement of the terminal metal fittings toward the rear side in their housing direction.

Description of Related Art

Connectors using a spacer that locks terminal metal fittings so that they are kept at prescribed positions in terminal housing chambers, respectively, are known.

For example, in one conventional connector (hereinafter referred to as "conventional connector"), from the viewpoint of, for example, its size reduction, an opening region 204 (which lacks a wall that divides the two adjacent terminal housing chambers 201) is formed between each pair of terminal housing chambers 201 that are adjacent to each other. A portion of a spacer is disposed in this opening region to prevent the terminal metal fitting from entering the opening region.

As for details of the above connection structure, refer to JP 2003-115341 A and JP 2015-195124A.

SUMMARY

The above conventional connector assumes that each terminal metal fitting that is locked by the spacer cannot move rearward in the housing direction unless the locking by the spacer is canceled. However, in actuality, if, for example, a strong force acts on an electric wire connected to a terminal metal fitting when the electric wire is routed, when the terminal metal fitting is pulled by the electric wire and pressed against the spacer, an event may occur that a portion (e.g., a thin-plate-like lock piece) of the terminal metal fitting digs into the spacer. In this case, the terminal metal fitting is moved rearward in the housing direction by a digging length.

In the conventional connector, although a portion of the spacer exists in part of the opening region between each pair of adjacent terminal housing chambers, the opening region is not closed completely. Thus, if a terminal metal fitting digs into the spacer in the above-mentioned manner, a portion of the terminal metal fitting may go into the opening region as the terminal metal fitting is rotated (inclined) about its portion that has dug into the spacer. In other words, the terminal metal fitting may be inclined in the terminal housing chamber in such a direction as to cross the housing direction. If the terminal metal fitting may be inclined too much, trouble may occur that in fitting the connector with a counterpart connector the terminal metal fitting cannot come into contact with a counterpart terminal properly and proper electrical connection cannot be established between them. It is therefore desirable that such inclination (positional deviation) of each terminal metal fitting be made as small as possible.

An object of the invention is to provide a connector capable of suppressing or preventing inclination of each terminal metal fitting in a terminal housing chamber even in a case that an opening region exists between each pair of adjacent terminal housing chambers.

Embodiments of the present invention provide the following items (1) and (2):

(1) A connector comprising:

a housing having a plurality of terminal housing chambers;

a plurality of terminal metal fittings each inserted into each of the plurality of the terminal housing chambers forwardly in a housing direction; and a spacer locking the plurality of the terminal metal fittings to restrict movement of the plurality of the terminal metal fittings backwardly in the housing direction, each of the plurality of the terminal metal fittings having a plate-like lock piece extending in the housing direction, and each of the plurality of the terminal metal fittings being locked by contacting a rear edge of the lock piece in the housing direction with the spacer, the housing having an opening region defined between each pair of the terminal housing chambers adjacent to each other and a support wall extending from a peripheral end portion of the opening region backwardly in the housing direction to decrease an opening area of the opening region, and the support wall supporting a tip portion of the terminal metal fitting housed in at least one of the pair of the terminal housing chambers to eliminate movement of the tip portion to come closer to the other of the pair of the terminal housing chambers through the opening region, even upon the terminal metal fitting housed in the at least one of the pair of the terminal housing chambers moving backwardly in the housing direction while allowing the rear edge of its lock piece digging into the spacer.

(2) The connector according to the item 1, wherein the length of the support wall in the housing direction is longer than the thickness in the housing direction of a portion of the spacer which portion is contacted with the lock piece.

According to first aspect of the invention, relating to the item (1), even if the female terminal is moved rearward in the housing direction while its lock piece digs into the spacer, the tip portion of the terminal metal fitting is supported by the support wall and hence inclination (positional deviation) of the terminal metal fitting is prevented. Thus, in the connector having this configuration, inclination of the terminal metal fitting in the terminal housing chamber can be prevented although an opening region exists between each pair of adjacent terminal housing chambers.

In addition to the above-described advantage, the connector having this configuration provides the following advantages. In general, the female terminal is manufactured by subjecting a plate member obtained by punching a metal plate into a prescribed shape to bending and other processing. The end surface (formed by punching) of the rear edge, in the housing direction, of the lock piece of the terminal metal fitting is approximately perpendicular to the major surface of the plate member (i.e., the housing direction). Thus, when the female terminal is moved rearward in the housing direction and its lock piece digs into the spacer, if the terminal metal fitting is not inclined, the lock piece T2*a* advances through the spacer with its end surface as the head. In contrast, if the female terminal is inclined, the lock piece advances through the spacer with the boundary between its end surface and its major surface (i.e., an angled edge formed by punching) as the head. In the latter case (the angled edge is the head), the lock piece more easily advances through the spacer while making rips and hence likely produces a greater digging length than in the former case (the end surface is the head). Thus, the former case (the end surface is the head) is preferable to the latter case (the edge is the head) in terms of reduction of the digging length. In other words, by preventing inclination of the terminal metal fitting by employing the above configuration, events can be prevented that the terminal metal fitting digs into the spacer too much and is thereby moved rearward excessively in the housing direction and that improper electrical connection to a counterpart terminal occurs.

According to second aspect of the invention, relating to the item (2), the length of the support wall is longer than the thickness of the spacer. Thus, even if the lock piece digs into the spacer, the tip portion of the terminal metal fitting is supported by the support wall and inclination (positional deviation) of the terminal metal fitting is prevented as long as the digging length of the lock piece is shorter than the thickness of the spacer. It can be said that in the connector having this configuration inclination of the terminal metal fitting can be prevented almost completely in a practical sense.

As described above, the invention can provide a connector capable of suppressing or preventing inclination of each terminal metal fitting in a terminal housing chamber even in a case that an opening region exists between each pair of adjacent terminal housing chambers.

Several aspects of the invention have been described briefly above. The further details of the invention will be made clearer if the following description is read through with reference to the accompanying drawings.

DETAILED DESCRIPTION

Embodiment

A connector 1 according to an embodiment of the present invention will be hereinafter described with reference to the drawings.

Figure 1:
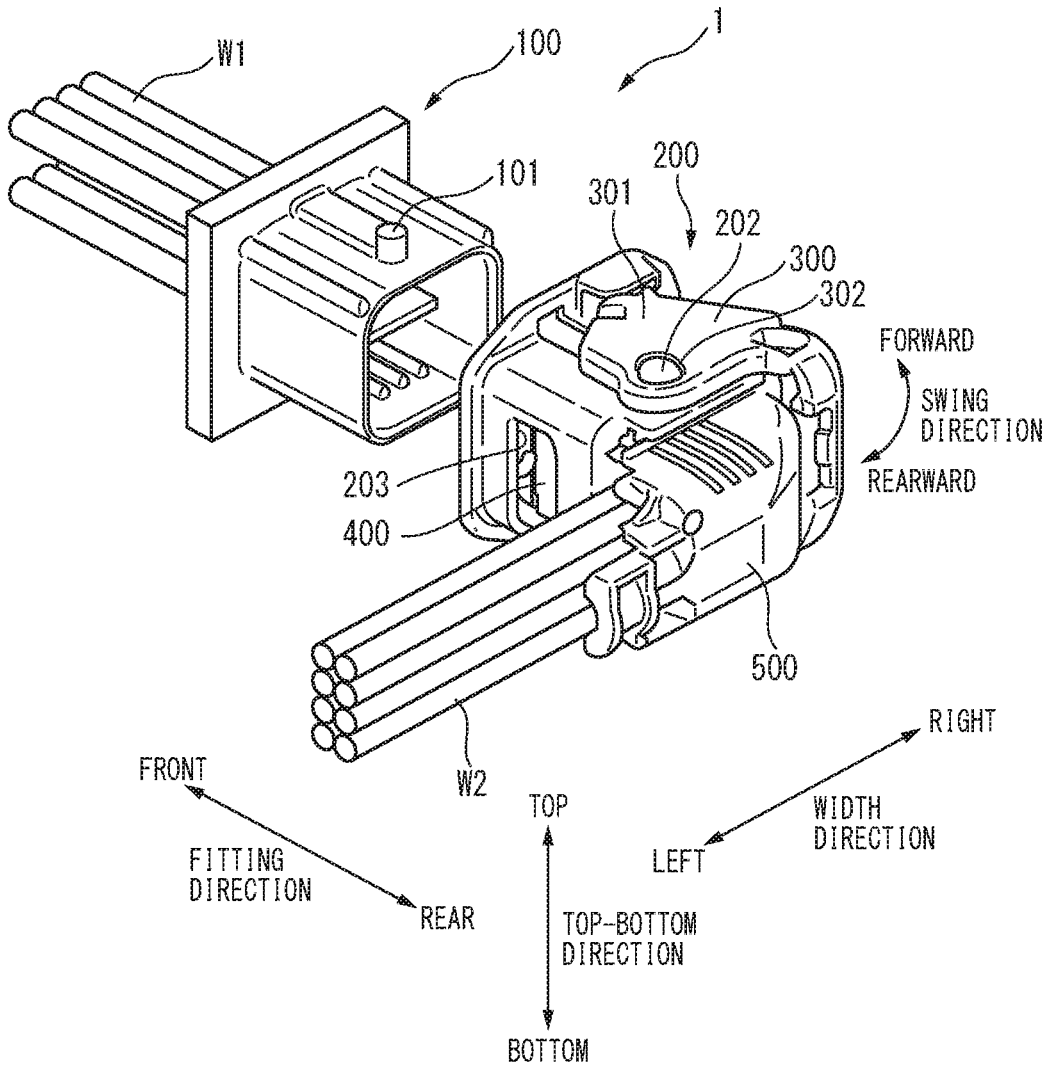
FIG. 1 is a perspective view of a connector according to an embodiment of the present invention in a state before a male housing is fitted into a female housing in which a spacer is disposed.

As shown in FIG. 1, the connector 1 according to the embodiment of the invention is equipped with a male housing 100, a female housing 200 which is fitted with the male housing 100 so as to house it (the male housing 100 is inserted in the female housing 200), a lever 300 which is attached to the female housing 200 swingably, a spacer 400 which is disposed in the female housing 200, and a wire cover 500 which is attached to the female housing 200.

The "fitting direction," "width direction," "top-bottom direction," "front side," "rear side," "left side," "right side," "top," "bottom," and "swing direction" of the lever 300. The fitting direction, the width direction, and the top-bottom direction are perpendicular to each other. FIG. 1 shows a state that the lever 300 is located at a tentative lock position (fitting start position). The lever 300 is moved toward a real lock position (fitting completion position) when swung rearward. The fitting direction corresponds to the term "housing direction" as used in the claims.

The male housing 100 is made of a resin and is shaped like a rectangular box. Plural male terminals T1 (see FIGS. 3A and 3B and FIGS. 4A and 4B) which are connected to end portions of plural (in the embodiment, eight) electric wires W1, respectively, are held by the male housing 100 inside so as to extend in the fitting direction. The top wall surface and the bottom wall surface of the male housing 100 are formed with respective cam bosses 101.

Figure 2:
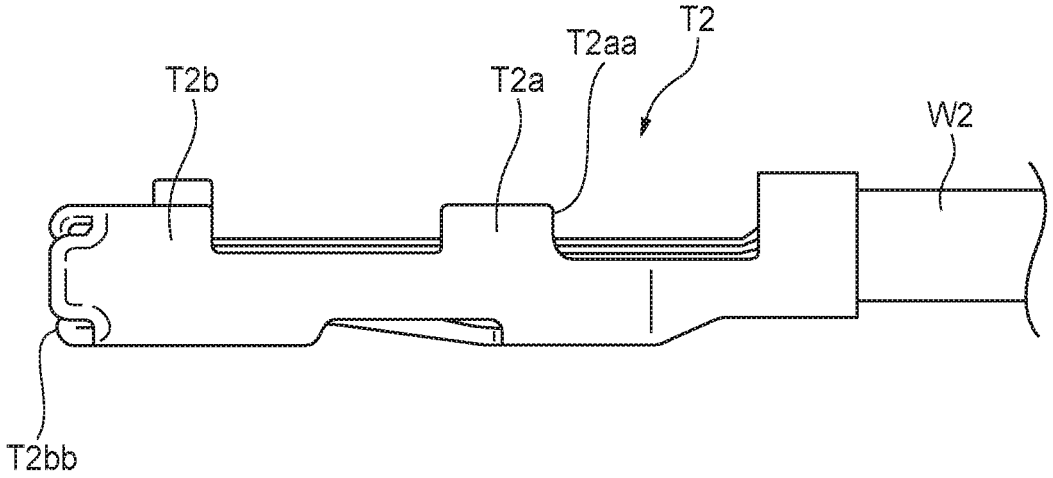
FIG. 2 is a side view of a female terminal that is housed in a female housing.

The female housing 200 is made of a resin and is shaped like a rectangular box. The female housing 200 is fitted with the male housing 100 so that the inner wall surface of the female housing 200 is placed on the outer circumferential surface of the male housing 100. Plural terminal housing chambers 201 (see FIGS. 3A and 3B) which houses plural respective female terminals T2 (see FIG. 2 and FIGS. 3A and 3B) which are connected to end portions of plural (in the embodiment, eight) electric wires W2, respectively, are formed inside the female housing 200 so as to extend in the fitting direction.

Figure 3A:
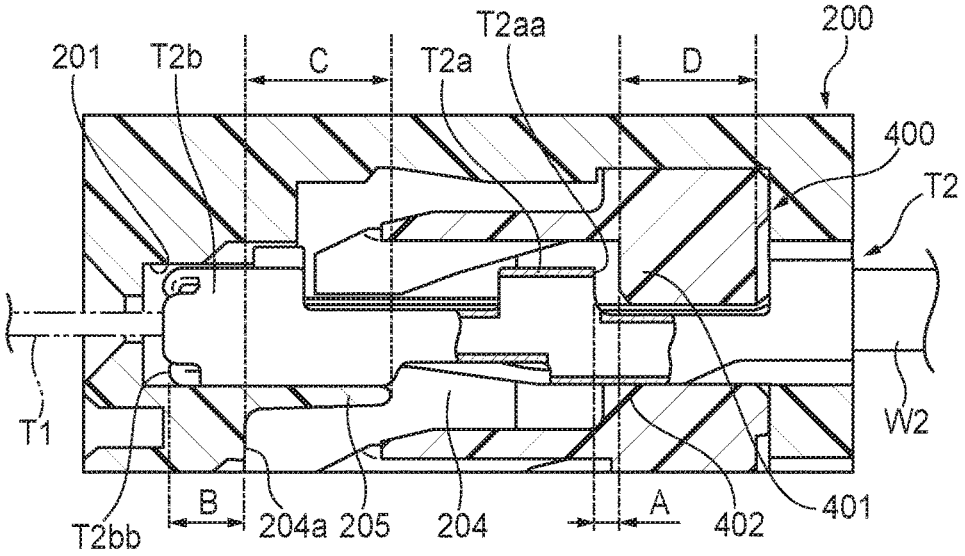
FIGS. 3A-3C are sectional views of a female housing and a spacer illustrating a state that a female terminal that is housed in the female housing is locked by the spacer that is disposed in the female housing.
Figure 3B:
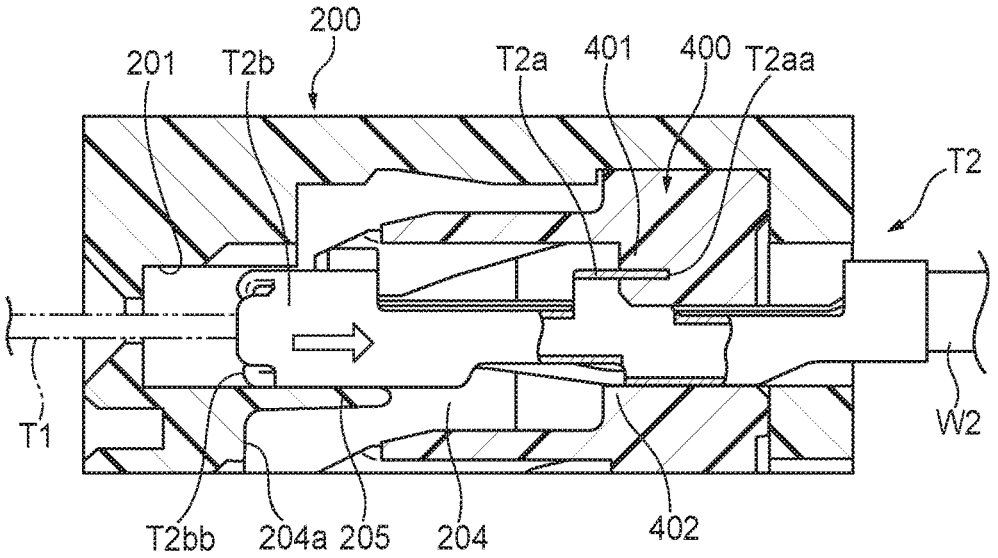
Figure 3C:
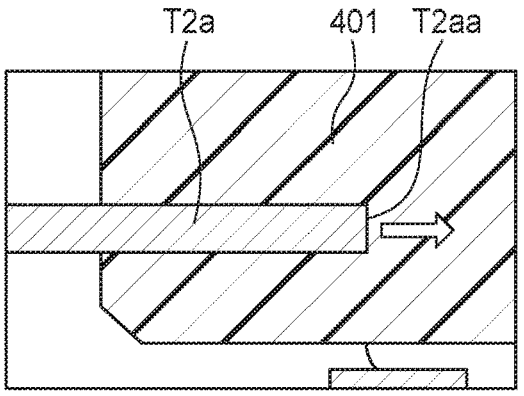

As shown in FIGS. 3A-3C, from the viewpoint of, for example, size reduction of the connector 1, the female housing 200 is formed with an opening region 204 (which lacks a wall that divides the two adjacent terminal housing chambers 201) between each pair of terminal housing chambers 201 that are adjacent to each other (in the top-bottom direction of FIGS. 3A-3C). The female housing 200 is also formed with a support wall 205 which extends rearward from an end portion 204*a*, defining the front end of the opening region 204, of the housing 200 so as to close a front-side region of the opening region 204 (i.e., to decrease the opening area of the opening region 204). The role etc. of the support wall 205 will be described later.

The top wall and the bottom wall of the female housing 200 are formed with respective rotation shafts 202 which project outward in the top-bottom direction. The pair of rotation shafts 202 are fitted in a pair of holes 302 of the lever 300, respectively, and the lever 300 is linked to the female housing 200 there. In this manner, the lever 300 is attached to the female housing 200 so as to be swingable about the pair of rotation shafts 202.

The lever 300 is made of a resin and is approximately U-shaped. The pair of holes (through-holes) 302 are formed through a pair of arms 301 of the lever 300, respectively. The pair of rotation shafts 202 of the female housing 200 are inserted in the pair of holes 302, whereby the lever 300 is swingable relative to the female housing 200 (about the pair of rotation shafts 202) with the female housing 200 sandwiched between the pair of arms 301.

Inside surfaces, in the top-bottom direction, of the pair of arms 301 of the lever 300 are formed with respective cam grooves (not shown). The pair of cam grooves are provided to pull the pair of cam bosses 101 of the male housing 100 from entrance portions to deepest portions of the cam grooves, respectively, as the lever 300 is swung from the tentative lock position to the real lock position.

The spacer 400 is made of a resin. Disposed in the female housing 200, the spacer 400 has a function of preventing the female terminals T2 (housed in the female housing 200) from coming off the female housing 200. The spacer 400 is inserted into the female housing 200 through an opening 203 (see FIG. 1) which is formed in the left side wall of the female housing 200, and is disposed at a prescribed position. As shown in FIG. 3A, when the spacer 400 is set as shown in FIG. 3A in a state that each female terminal T2 is housed in the associated terminal housing chamber 201 of the female housing 200 so as to be located at its regular position, an engagement portion 401 of the spacer 400 is rendered in such a state as to be able to engage with a rear edge T2*aa* of a lock piece T2*a* of the female terminal T2. The lock piece T2*a* is a plate-like piece extending in the fitting direction and is formed around the center, in the front-rear direction, of the female terminal T2. In this state, a portion 402 of the spacer 400 is located in a rear region of the opening region 204 so as to close the rear region of the opening region 204 between the two terminal housing chambers 201.

In a state that the spacer 400 is disposed at the prescribed position in the female housing 200, when the rear edge T2*aa* of the lock piece T2*a* comes into contact with the engagement portion 401 of the spacer 400, the female terminal T2 housed at the regular position is prevented from coming off rearward. That is, the spacer 400 locks the female terminal T2 so as to restrict a rearward movement of the female terminal T2. Furthermore, the spacer 400 closes the rear region of the opening region 204 and thereby prevents a rear portion of the female terminal T2 from entering the rear region of the opening region 204.

Again referring to FIG. 1, the wire cover 500 is made of a resin, is provided in the female housing 200, and has a function of restricting the routing direction of the electric wires W2 that are connected to the respective female terminals T2. In the embodiment, as shown in FIG. 1, the wire cover 500 routes the electric wires W2 extending rearward in the fitting direction from the female terminals T2 so that the electric wires W2 are bent and then extend leftward.

The male housing 100 is fitted, using the lever 300, into the female housing 200 in which as described above the female terminals T2 are held in the respective terminal housing chambers 201 by means of the spacer 400. How to use the lever 300 in fitting the male housing 100 into the female housing 200 is the same as in common lever-type connectors and hence will not be described in detail.

The role of the support wall 205 in the connector 1 according to the embodiment of the invention will be described below.

As described above, as shown in FIGS. 3A and 3C, the female housing 200 of the connector 1 is provided with the support wall 205 which extends rearward from the end portion 204*a*, defining the front end of each opening region 204, of the housing 200 so as to close a front-side region of the opening region 204. Before describing the role of the support wall 205, first, a case (comparative example) in which the support wall 205 is not provided will be described with reference to FIGS. 4A-4C.

Figure 4A:
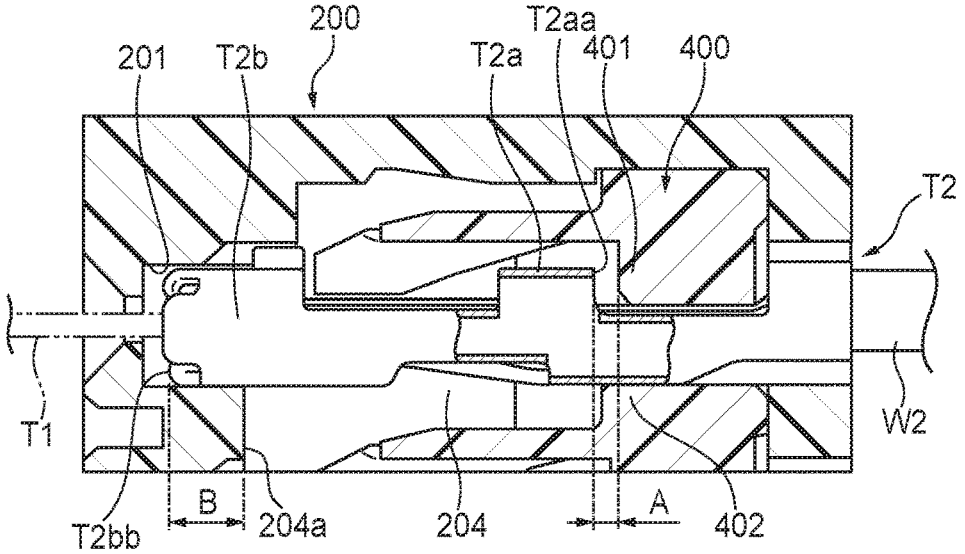
FIGS. 4A-4C are sectional views of a female housing and a spacer of a comparative example illustrating a state that a female terminal that is housed in the female housing is inclined inside a terminal housing chamber.

In this comparative example, in the state shown in FIG. 4A, a gap having a dimension A exists between the rear edge T2*aa* of the lock piece T2*a* and the engagement portion 401 of the spacer 400. In this state, a tip surface T2*bb* of a tip portion T2*b* of the female terminal T2 is spaced forward in the fitting direction by a dimension B from the end portion 204*a*, defining the front end of the opening region 204, of the housing 200. There is a relationship B>A.

Thus, even if the female terminal T2 is moved rearward (rightward in FIG. 4A) by the dimension A from the state of FIG. 4A and the rear edge T2*aa* of the lock piece T2*a* comes into contact with the engagement portion 401 of the spacer 400, the tip surface T2*bb* of the female terminal T2 is located on the front side of the end portion 204*a*, defining front end of the opening region 204, of the housing 200. It is therefore considered that tip portion T2*b* of the female terminal T2 does not go into the opening region 204 unless the female terminal T2 is moved rearward further through engagement (contact) of the rear edge T2*aa* of the lock piece T2*a* with the engagement portion 401 of the spacer 400.

Figure 4B:
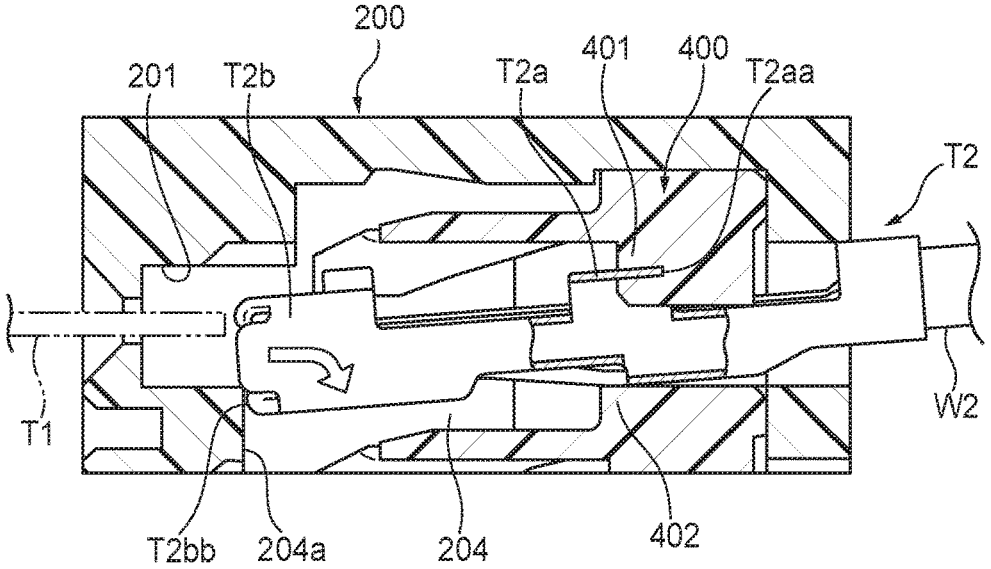
Figure 4C:
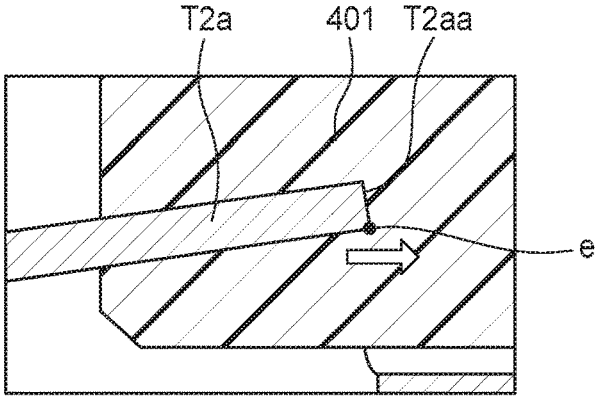

However, in actuality, if the female terminal T2 is pulled by the electric wire W2 connected to it and the rear edge T2*aa* of the lock piece T2*a* is pressed against the engagement portion 401 of the spacer 400 when, for example, a strong external force acts on the electric wire W2 in routing the electric wire W2, as shown in FIGS. 4B and 4C there may occur an event that the rear edge T2*aa* of the metal lock piece T2*a* digs into the engagement portion 401 of the resin spacer 400 and the female terminal T2 is moved rearward further.

In the comparative example, although the rear region of the opening region 204 is closed by part of the spacer 400, the front region of the opening region 204 is not closed. Thus, when as mentioned above the rear edge T2*aa* of the metal lock piece T2*a* digs into the engagement portion 401 of the resin spacer 400, the tip portion T2*b* of the female terminal T2 may go into the front region of the opening region 204 as the female terminal T2 is rotated (inclined) about its portion that has dug into the engagement portion 401 of the spacer 400.

Even if such inclination occurs, the connection of the male terminal T1 and the female terminal T2 suffers no particular problem as long as the inclination is small. However, if as shown in FIG. 4B the female terminal T2 is displaced from the male terminal T1 to a large extent, they could not come into contact with each other properly to cause improper connection. In the comparative example, as shown in FIG. 4B, a tip portion of the male terminal T1 hits a peripheral portion of the female terminal T2 and the male terminal T1 cannot be inserted into the female terminal T2. It is thus seen that it is desirable to suppress or prevent the inclination of the female terminal T2.

In view of the above, as shown in FIG. 3A, the female housing 200 of the connector 1 according to the embodiment has the support wall 205 which extends rearward from the end portion 204*a*, defining the front end of the opening region 204, of the housing 200 so as to close the front region of the opening region 204. The length C of the support wall 205 in the front-rear direction is set longer than the thickness D, in the front-rear direction, of the engagement portion 401 of the spacer 400 with which the lock piece T2*a* is to come into contact.

Since the support wall 205 is provided in the above manner, even if the female terminal T2 is moved rearward while its lock piece T2*a* digs into the spacer 400, the tip portion T2*b* of the female terminal T2 is supported by the support wall 205. This prevents inclination (positional deviation) of the female terminal T2. Thus, even if an event occurs that the female terminal T2 digs into the spacer 400 in the case where the opening region 204 exists between the adjacent terminal housing chambers 201, inclination of the female terminal T2 in the terminal housing chamber 201 can be prevented. As a result, in the connector 1, even in a use environment that a strong external force acts on the electric wires W2, the male terminal T1 and the female terminal T2 can be connected to each other more reliably than in the comparative example shown in FIGS. 4A-4C in which the support wall 205 is not formed.

In addition to the above-described advantage, the connector 1 according to the embodiment provides the following advantages.

In general, the female terminal T2 is manufactured by subjecting a plate member obtained by punching a metal plate into a prescribed shape to bending and other processing. The end surface (formed by punching) of the rear edge T2*aa* of the lock piece T2*a* of the female terminal T2 manufactured in this manner is approximately perpendicular to the major surface of the plate member (i.e., the fitting direction). Thus, when the female terminal T2 is moved rearward and its lock piece T2*a* digs into the spacer 400, if the female terminal T2 is not inclined, as shown in FIGS. 3B and 3C the lock piece T2*a* advances through the spacer 400 with the end surface of its rear edge T2*aa* as the head.

In contrast, if the female terminal T2 is inclined, as shown in FIGS. 4B and 4C the lock piece T2*a* advances through the spacer 400 with the boundary between its rear edge T2*aa* and its major surface (i.e., an angled edge e formed by punching; see FIG. 4C) as the head.

In the latter case (the edge e is the head), the lock piece T2*a* more easily advances through the spacer 400 while making rips and hence the female terminal T2 likely produces a greater digging length than in the former case (the end surface is the head). Thus, the former case (the end surface is the head) is preferable to the latter case (the edge e is the head) also in terms of reduction of the digging length. If the digging length is too great, even if the inclination of the female terminal T2 is small, there may occur an event that the male terminal T1 and the female terminal T2 are separated from each other so much as not to be connected to each other properly.

Thus, if the inclination of the female terminal T2 is suppressed or prevented as in the case of the connector 1 shown in FIGS. 3A-3C, an event can be prevented that the female terminal T2 digs into the spacer 400 too much and is thereby moved rearward excessively. By suppressing a rearward movement of the female terminal T2, occurrence of improper electrical connection between the male terminal T1 and the female terminal T2 can be prevented.

Furthermore, the length C of the support wall 205 is longer than the thickness D of the engagement portion 401 of the spacer 400. Thus, even if the lock piece T2*a* digs into the engagement portion 401, the tip portion T2*b* of the female terminal T2 is supported by the support wall 205 and inclination (positional deviation) of the female terminal T2 is prevented as long as the digging length of the lock piece T2*a* is shorter than the thickness D of the spacer 400 (i.e., the lock piece T2*a* does not penetrate through the engagement portion 401). It can be said that in a practical sense inclination of the female terminal T2 in the connector can be prevented almost completely.

Other Embodiments

In addition, the invention is not limited to the aforementioned embodiments, but various modifications can be used within the scope of the invention. For example, the invention is not limited to the aforementioned embodiments, but changes, improvements, etc. can be made on the invention suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

For example, although in the embodiment the lever 300 is provided to assist fitting of the male housing 100 into the female housing 200, the connector according to the invention need not always be quipped with such a lever. Furthermore, in the embodiment, the lever 300 is attached to the female housing 200 so as to be swingable about the rotation shafts 202. Alternatively, the lever 300 may be attached to the female housing 200 so as to be slidable with respect to it.

Here, the features of the aforementioned embodiment of the connector according to the invention will be summarized and listed briefly in the following paragraphs [1] and [2].

[1] A connector (1) comprising:

a housing (200) having a plurality of terminal housing chambers (201);

a plurality of terminal metal fittings (T2) each inserted into each of the plurality of the terminal housing chambers forwardly in a housing direction; and a spacer (400) locking the plurality of the terminal metal fittings to restrict movement of the plurality of the terminal metal fittings backwardly in the housing direction, each of the plurality of the terminal metal fittings having a plate-like lock piece (T2*a*) extending in the housing direction, and each of the plurality of the terminal metal fittings being locked by contacting a rear edge (T2*aa*) of the lock piece in the housing direction with the spacer, the housing having an opening region (204) defined between each pair of the terminal housing chambers adjacent to each other and a support wall (205) extending from a peripheral end portion (204*a*) of the opening region backwardly in the housing direction to decrease an opening area of the opening region, and the support wall supporting a tip portion (T2*b*) of the terminal metal fitting housed in at least one of the pair of the terminal housing chambers to eliminate movement of the tip portion to come closer to the other of the pair of the terminal housing chambers through the opening region, even upon the terminal metal fitting housed in the at least one of the pair of the terminal housing chambers moving backwardly in the housing direction while allowing the rear edge of its lock piece digging into the spacer.

[2] The connector according to the item [1], wherein the length (C) of the support wall (205) in the housing direction is longer than the thickness (D) in the housing direction of a portion (401) of the spacer (400) which portion is contacted with the lock piece (T2*a*).

REFERENCE SIGNS LIST

1: Connector
200: Female housing (housing)
201: Terminal housing chamber
204: Opening region
204*a*: End portion
205: Support wall
400: Spacer
500: Wire cover (cover)
T2: Female terminal (terminal metal fitting)
T2*a*: Lock piece
T2*aa*: Rear edge
T2*b*: Tip portion

The invention claimed is:

1. A connector comprising:

a housing having a plurality of terminal housing chambers;

a plurality of terminal metal fittings each inserted into a corresponding one of the plurality of the terminal housing chambers forwardly in a housing direction; and a spacer locking the plurality of the terminal metal fittings to restrict movement of the plurality of terminal metal fittings rearwardly in the housing direction, each of the plurality of terminal metal fittings having a plate-like lock piece extending in the housing direction, and each of the plurality of terminal metal fittings being locked by a rear edge of the lock piece in the housing direction contacting the spacer, the housing having an opening region defined between each pair of the terminal housing chambers adjacent to each other and a support wall extending from a peripheral end portion of the opening region rearwardly in the housing direction to decrease an opening area of the opening region, and the support wall supporting a tip portion of the terminal metal fitting housed in at least one of the pair of the terminal housing chambers to prevent movement of the tip portion from coming closer to the other of the pair of the terminal housing chambers through the opening region, even upon the terminal metal fitting housed in the at least one of the pair of the terminal housing chambers moving rearwardly in the housing direction while allowing the rear edge of the lock piece to dig into the spacer, wherein the rear edge of the lock piece contacts the spacer at a first position rearward of the support wall and the opening region in the housing direction, the first position being on a first side of the terminal metal fitting perpendicular to the housing direction and opposite to a second position, rearward of the support wall and the opening region in the housing direction, on a second side of the terminal metal fitting perpendicular to the housing direction, the support wall and the opening region being located on the second side of the terminal metal fitting.

2. The connector according to claim 1, wherein the length of the support wall in the housing direction is longer than the thickness, in the housing direction, of a portion of the spacer which contacts the lock piece.

3. The connector according to claim 1, wherein the rear edge of the lock piece contacts the spacer rearwardly of the opening region in the housing direction.

* * * * *